United States Patent [19]

Coombes

[11] 3,939,743

[45] Feb. 24, 1976

[54] PUNCH FOR FILM PRODUCTS HAVING IMPROVED SLUG REMOVAL FACILITY

[75] Inventor: William S. Coombes, Somerset, Mass.

[73] Assignee: Sheldahl, Inc., Northfield, Minn.

[22] Filed: Feb. 18, 1975

[21] Appl. No.: 550,203

[52] U.S. Cl. ..... 83/98; 83/123; 83/639

[51] Int. Cl.[2] ..... B26D 7/18

[58] Field of Search ..... 83/98, 99, 639, 687, 123

[56] References Cited

UNITED STATES PATENTS

| | | | |
|---|---|---|---|
| 3,236,130 | 2/1966 | Robert | 83/98 |
| 3,580,120 | 5/1971 | Adams et al. | 83/639 |
| 3,771,369 | 11/1973 | Im | 83/98 |

*Primary Examiner*—Donald R. Schran
*Attorney, Agent, or Firm*—Orrin M. Haugen

[57] ABSTRACT

An improved punch drive means and control means for a punch assembly adapted for preparation of flexible film products. The punch drive means includes a double acting cylinder with a piston and ram operatively associated therewith, and a film slug ejecting means is provided for utilization with the punch. The double acting cylinder for the punch drive means is provided with a control valve which receives compressed air from an air manifold for controlled actuation of the drive cylinder. The film slug ejecting means is provided with a separate control valve which is also coupled to the air manifold, and means are provided for controlling the delivery of compressed air from the manifold to the ejecting port located in the punch.

2 Claims, 5 Drawing Figures

PUNCH FOR FILM PRODUCTS HAVING IMPROVED SLUG REMOVAL FACILITY

BACKGROUND OF THE INVENTION

The present invention relates generally to an improved reciprocating punching mechanism, and more particularly to a high speed heavy duty reciprocating punch device especially adapted for use in connection with thin flexible film materials. The punching mechanism is adapted to handle multi-ply films wherein the cumulative thickness becomes substantial. The punch apparatus includes relatively movable punch and die assemblies, the punch assembly having a cutter adapted to pass through the surface of the film at the point of the die so as to form openings, holes or slots within the film material passing through the working zone between the punch and die. Clamping shoe means are provided for retaining the flexible film material in taut disposition during punching, and in addition, means are provided for ejecting or removing the slug of film material which is obtained or formed upon a punching operation or event. Improved drive and control means are provided which utilize a double acting cylinder for extending and retracting the punch, and, in addition, a separate valve and control means is provided for delivering compressed air to the slug ejecting apparatus.

In the forming of holes or slotted openings in thin film materials, it is extremely important that the location of the holes be accurately positioned. Furthermore, products frequently demand the formation of clean, non-scalloped openings or bores in the film, and ragged or scalloped surfaces are accordingly undesirable and may contribute to the generation of scrap. Furthermore, film materials may be abrasive and cause considerable wear on punching equipment, and the extent of wear or lack of sharpness of the cutting tool becomes a less critical factor when the clamping apparatus of the present invention is being employed on the film. The improved drive and control means of the present invention provides for reliable operation of the punching apparatus, with the drive function and the ejection function being rendered independent, one of the other.

SUMMARY OF THE INVENTION

Briefly, in accordance with the present invention, a punch for film materials is provided with a punch member adapted to reciprocate between a normal disposition and an extended disposition, with the motion being along a linear path of a certain predetermined length. The punch is provided with a cutting surface which engages the film while the punch is moving from its normal disposition to its extended disposition for the purpose of performing an operation on the film. The film is adapted to move as a web through a plane in the jaw zone separating the punch and the die, with the film moving intermittently so as to have alternate periods of draw and dwell, with the periods of dwell existing, of course, between intermittent periods of motion. While the film is at dwell, the punch is moved reciprocatorily into contact with the film and the die and the punching operation is accordingly accomplished. Ram means are provided to stroke or drive the punch, with such means being a double-acting cylinder driven with compressed air, with the compressed air being timely pulsed, as required. The improved drive and control means of the present invention provides for positive driving of the ram, and isolates the ram driving system from the slug ejection system.

In order to retain the flexible film in taut disposition on the die during the punching operation, a clamping shoe is provided which is slidably secured to the punch and adapted to move with the punching member during stroking thereof. The clamping shoe is further arranged to engage the film prior to the punch reaching its bottom dead-center position, thereby clamping the film against the surface of the die or die base; thus securing the film in taut disposition at the point in time when the cutting surfaces of the punch engage the surface of the film. A raised annular flange is provided about the surface of the die base surrounding the die bore or opening so as to increase the tautness of that portion of the film held above the die bore and within, about and through the area to be severed or cut, thereby forming a clean cut in the film which is free of scalloping and other surface irregularities.

It is therefore a primary object of the present invention to provide an improved drive and control means for use in connection with a punch assembly for the perforation of flexible film products, the drive and control means being arranged so as to perform their functions independently, one of the other.

It is yet a further object of the present invention to provide an improved punching mechanism for use with flexible film materials, and wherein the punching mechanism is adapted for reliable and positive action, thereby permitting utilization with multiple plies of film having substantial cross-sectional thicknesses.

Other and further objects of the present invention will become apparent to those skilled in the art upon a study of the following specification, appended claims, and accompanying drawings.

DESCRIPTION OF THE PREFERRED EMBODIMENT

Figure 1:
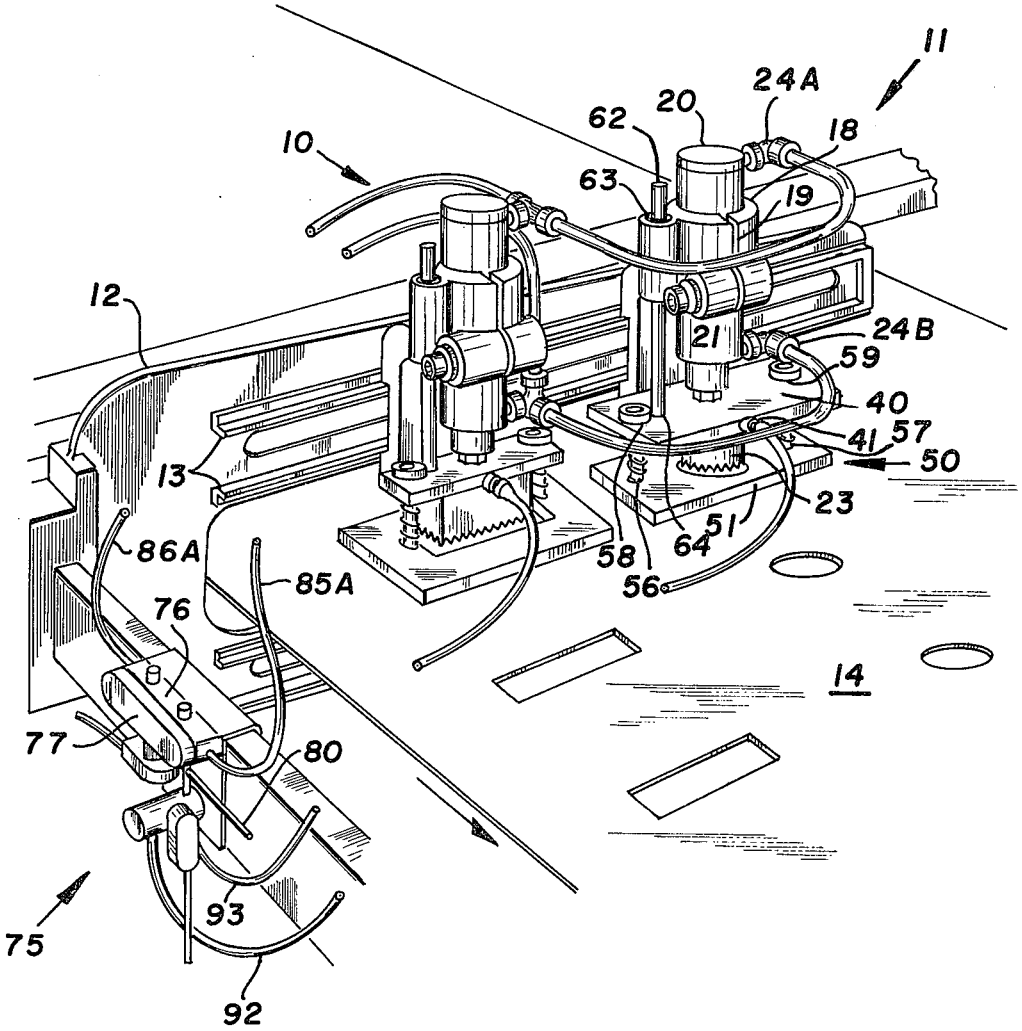
FIG. 1 is a front perspective view of a pair of punch assemblies arranged on a transversely extending bracket, and being driven with the drive and control system of the present invention, the punches being shown with a web of flexible film material being moved between the punch and die.

In accordance with the preferred embodiment of the present invention, and with particular attention being directed to FIG. 1 of the drawings, there is shown first and second punch assemblies being mounted on a transversely extending frame or bracket 12. Means are provided for adjusting the lateral positioning of punches 10 and 11 along the bracket 12, these means including for example, the provision of mounting rails such as are shown, for example, at 13. The work web of film material is shown generally at 14, and, as indicated, passes beneath the individual punches 10 and 11. With attention being directed temporarily to FIG. 2 of the drawings, a cooperating die assembly shown generally at 16 is provided and disposed immediately below the surface of the film 14, the operation of the punch and die being made manifest hereinafter.

Figure 3:
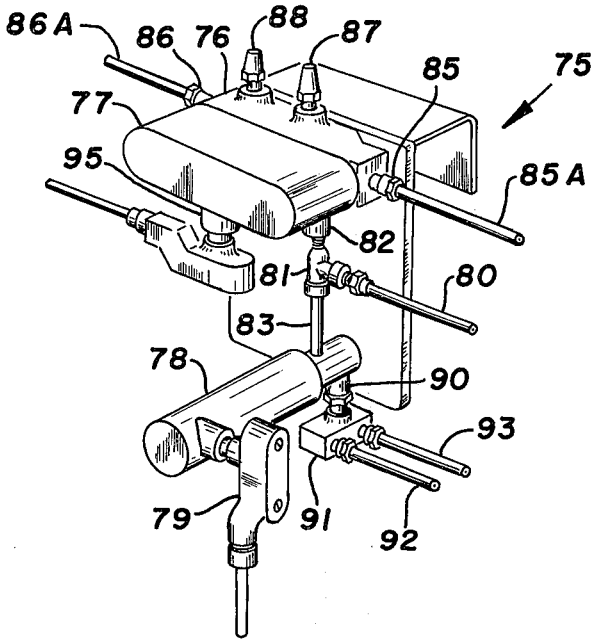
FIG. 3 is a detail perspective view showing the drive and control system of the present invention.
Figure 4:
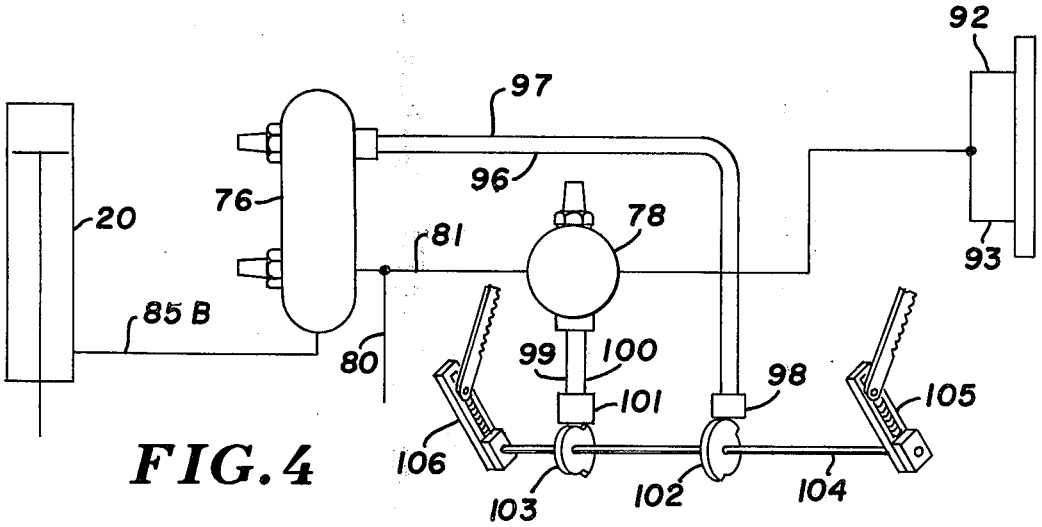
FIG. 4 is a schematic diagram of the pneumatic and electrical control system illustrated in FIG. 3.

With the exception of the actual configuration of the punch and die assemblies, the punches 10 and 11 are substantially identical, one to another, and hence this description will relate the details only of the punch 11, it being understood that the details of construction of punch 10 are generally identical to those of punch 11. Each punch includes a mounting head 18, the head having a support sleeve configuration as at 19 so as to adjustably retain the punch drive cylinder 20 therewithin. In other words, the drive cylinder 20 is received within the confines of the split head 18, and may be disposed at any preferred elevation relative to the surface of the film 14, D-ring screw being provided at 21 to accomplish this purpose. The punch is provided with a rod, ram, or shank portion 22, the punching head 23 with its die engaging surface or face being secured to the forward end thereof, the ram 22 and die engaging face of punch 23 being adapted to move reciprocably within or through a bore formed in the die, with motion being provided by the drive cylinder 20 and shown in detail FIG. 2. The details of the action of the drive and control system, as illustrated in FIGS. 3 and 4, will be described in greater detail hereinafter. Means are provided to transmit fluid under pressure to the upper cylinder port 23 for driving the punching head downwardly, while port 24B is adapted to receive fluid under pressure for returning and retaining the punch to its elevated or normal disposition. Thus, drive cylinder 20 is a dual acting air cylinder having a piston 30 operating within the housing or sleeve 31 and being secured to the top or inner end of the ram 22. as at 32. Suitable guide means and bushings are provided along with an "O"-ring seal 39, O -ring 39 preventing leakage of compressed fluid around the moving shank or ram portion 22 as is conventional in this type of drive system.

With continued attention being directed to FIG. 2 of the drawings, it will be observed that the mounting or backing member of punch 23, such as at 40, is provided with a hose fitting or tubing receiving fitting 41, with a length of tubing being shown coupled to said fitting, this fitting thereby being adapted to receive a hose line carrying compressed air so as to deliver pulses of air for slug ejection as disclosed in detail hereinafter. Compressed fluid accordingly enters bore 42 and is delivered outwardly into the interior confines of die engaging face of punch 23 at a point in time when punch 23 has severed a slug of film from web 14, thereby ejecting the film slug from the core or interior of die engaging face 23. With continued attention being directed to FIG. 2, it will be observed that the ejected slug will be discharged through skirt member or the like 43 which functions as a bag holder for receipt of ejected slugs. Annular spring member 44 is retained on chain member 45 for the purpose of periodic removal of a bag, not shown, which hangs in distended relationship from skirt member 43, the inner periphery of which is captured between skirt 43 and spring 44.

Figure 2:
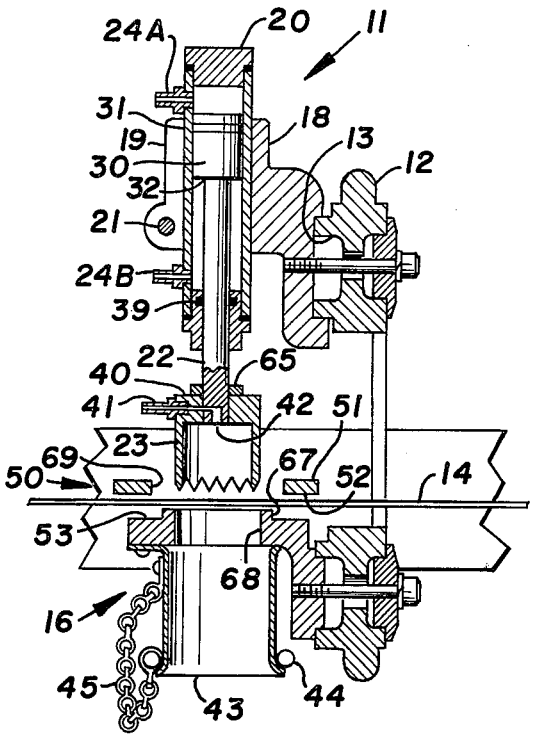
FIG. 2 is a vertical sectional view taken generally along the central axis of the punch illustrated in FIG. 1, this figure including a showing of the cooperating die immediately beneath the surface of the film.

With continued attention being directed to FIGS. 1 and 2 of the drawings, it will be observed that film clamping means generally designated 50 is provided, the film clamping means including a film clamping shoe 51 having a lower film clamping surface 52 which cooperates with an upper film clamping surface 53 of die assembly 16 such as the upper surface of the die base. Film clamping assembly 50 is resiliently coupled and slidably secured to the reciprocating punch as is shown in FIG. 2. In this view, mounting or backing member 40 extends radially or laterally outwardly of punch 23 and is provided with a pair of support posts 56 and 57 which are secured at their lower ends to clamping shoe 51. A pair of threadedly engaged adjustment collars are provided at the upper end of members 56 and 57, as at 58 and 59, it being understood that collars 58 and 59 are arranged to control the normal disposition of clamping shoe 51, and likewise the extent of throw during each operational stroke of the punching member.

In order to aid in lateral support and adjustment of the punching mechanism, a guide rod 62 may be employed, which is arranged to move relative to mounting head 18 through a bronze bushing 63. The lower end of guide rod 62 is coupled to the inner surface of the closed end of die engaging face 23 as at 64. Also, as is apparent in the drawings, jam nut 65 may be utilized to suitably retain punch member 23 in place at the terminal end of the ram.

Attention is now directed to the upper surface 53 of die 16, and particularly to the flanged projection 67 which extends outwardly from surface 53. This flange extends and circumscribes the bore 68 which is formed in the die assembly, with bore 68 making film cutting contact with punch 23 during an actual cutting operation. Flange 67 provides an annulus zone or space between the inner periphery of the opening formed in clamping shoe 51, as at 69, and the outer periphery of flange 67. The purpose of this annulus is to permit the film to be drawn smoothly but tautly about the member 67 for ultimate engagement or contact with punch 23. A combined spring force of several pounds is normally sufficient for the film clamping operation.

Attention is now directed to FIGS. 3 and 4 of the drawings which illustrate the details of the control system for the drive means and the slug ejection means. Specifically, in FIG. 3, the control means generally designated 75 includes a valve 76 which is a four-way valve controlled by means of control solenoid 77. A second control valve is illustrated at 78, this valve normally being a solenoid controlled shut-off valve, normally closed. A control for the solenoid valve 78 is shown at 79.

Compressed air is delivered to the valves through line 80, the line being coupled to a suitable source of compressed air, typically air at 100 psi. Line 80 communicates with "T" 81 which forms a manifold means extending between the inlet 82 to valve 76, and inlet 83 to valve 78. Therefore, the pneumatic input to valves 76 and 78 is independent, one of the other, thereby enhancing the positive action available from the drive mechanism.

Turning now to valve 76, as has been indicated, control valve 76 is a four-way valve having an inlet 82 and a normally open outlet 85 and a normally closed outlet 86. A pair of exhaust ports are provided at 87 and 88, as is conventional in this type of valve. The interior of valve 76 is provided with a plunger which moves between its normal disposition providing the normal porting to an actuated condition wherein normally open port 85 closes and normally closed port 86 opens. Such valves, of course, are commercially available. Normally closed port 86 is provided with a conduit or tubing member 86A which is, in turn, coupled to port 24A of drive cylinder 20, while normally open port 85 is provided with conduit or tubing 85B which is, in turn, coupled to port 24B of drive cylinder 20.

Turning now to control valve 78, this valve is provided with a normally closed outlet as at 90, with outlet 90 being in communication with an outlet manifold such as T 91, which is provided with multiple ports for delivering a controlled blast of air to the ejection ports of each of the punches 10 and 11, with conduit means 92 and 93 being provided for this purpose. In this embodiment, tubing 92 is coupled directly to fitting 41, as is illustrated in FIG. 2 of the drawings. Tubing 93 would, in turn, be coupled directly to a corresponding fitting in a different punch assembly.

Attention is now directed to FIG. 4 of the drawings where the electrical schematic is illustrated for control of the valves 76 and 78. Specifically, valve 76 has a pair of leads extending from control lead receiving port 95 (FIG. 3), with leads 96 and 97 being shown in FIG. 4 as extending to cam actuated contacts 98. Solenoid valve 78 is provided with a pair of leads 99 and 100, which extend to cam actuated switch 101. Cams 102 and 103 are coupled to the main drive shaft 104 of a bag-making machine which is disclosed in detail in U.S. Pat. 2,947,345, G. T. Schjeldahl dated Aug. 2, 1960. In the view of FIG. 4, shaft 104 corresponds in its entirety to the main continuously rotating drive shaft, with a pair of cranks 105 and 106 being coupled to opposed ends of shaft 104. Cam switch 98 is actuated by cam 102, the lobes of cam 102 being designed to close the contact of cam switch 98 during those periods of time that the film web is at dwell in the apparatus. This will, in most instances, occur when the machine is operating between 180° and 360° of machine motion. In order to assure the removal of the punch from the area of the film prior to initiation of the draw cycle, it is normally desired that cam switch 98 be returned to its normal disposition shortly before the draw cycle is initiated, such as at 350° of machine motion.

Cam switch 101 is provided with contacts controlled by cams 103, with these contacts being closed at a point in time subsequent to actuation of cylinder 20, preferably generally midway of the entire punch cycle. Accordingly, cam switch 101 will normally be actuated between approximately 265° and 295° of machine motion.

Machine motion may be defined as a series of cycles, with the cycles being determined by each rotation of shaft 104. At the initiation of the web of the forward draw of the web 14, the apparatus is defined as being at its "zero degree" disposition. The draw cycle, with cranks 105 and 106 controlling the draw cycle, terminates at 180° of machine motion, with cooperating racks extending from cranks 105 and 106 providing reverse motion during the period of 180°–360° of machine motion.

With attention now being directed to FIGS. 1 and 2 of the drawings, it will be observed that the web of film 14 is engaged by the clamping shoe and retained tautly across the bore formed in the die. Upon advance of the punch 23 through the film and into the die area or zone, the taut film is severed cleanly and a blast of compressed air or other gaseous fluid passes through the bore 42 and thence into the punching head to eject the removed slug through skirt 43 and into a slug-receiving bag hanging from skirt 43. The punch mechanism of the present invention may be located or mounted in any desired location relative to the film web, wherein any portion of the web may be reached. The punch and associated die may be mounted in the system to achieve the desired punching pattern in the film being treated. Obviously, multiple punches may be provided in the machine direction as well as in the transverse direction, with the requirements being dictated by the overall finished product being prepared.

Figure 5:
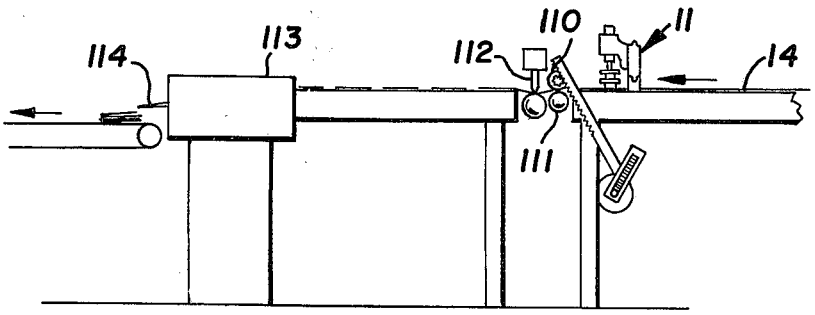
FIG. 5 is a side elevational view of a portion of a typical web handling system which includes the punches and control systems illustrated in FIG. 1–4.

A typical installation is illustrated in FIG. 5 wherein the punching system 11 is being utilized to treat a moving web of film 14. The system is provided with draw rolls 110 and 111 along with a sealing bar as at 112. The operation is coordinated so that during dwell of the film 14, the punching operation as well as the sealing operation will occur. Following severing of a flexible film article from the web by the bar 112, or other cutting mechanism, a conveyor transports the finished article to a discharge area 113, the finished articles 114 being discharged, as indicated. This arrangement, as illustrated, is a typical side-weld product forming operation, and it will be appreciated, of course, that a variety of other operations may be employed on a film product while utilizing the punch system and drive and control apparatus of the present invention in conjunction therewith.

I claim:

1. In combination with a punch assembly for perforation of flexible film products with cooperatively arranged punch and die assemblies, and means for ejecting film slugs from said punch means; pneumatic punch drive means and control means for said punch drive means and said film slug-ejecting means:

a. said punch assembly including frame means for retaining a reciprocating punch and a stationary die, a punch assembly including a punch member mounted on said frame means and including drive means for stroking said punch member in reciprocatory to-and-fro motion for extension and retraction thereof along a certain linear path;

b. a die-assembly mounted on said frame means and having a punch-receiving bore formed therein;

c. said pneumatic punch drive means comprising a double acting cylinder with a piston and ram operatively associated therewith, axially spaced port means for introducing compressed gaseous fluid into said cylinder including a first port for drivably extending and a second port for drivably retracting said piston and ram;

d. said film slug-ejecting means comprising slug-ejection port means on said punch means for receiving compressed gaseous fluid and delivering said compressed gaseous fluid to the interior of said punch means for ejection of film slugs outwardly of said punch means;

e. said control means comprising manifold means for receiving compressed gaseous fluid under pressure, first control valve means having an inlet coupled to said manifold means and having a pair of outlets alternately coupled to said inlet and including a normally open and a normally closed outlet with said normally open outlet having conduit means coupling said normally open outlet to said second cylinder port and with said normally closed outlet having conduit means coupling said normally closed outlet to said first cylinder port;

f. second control valve means having an inlet coupled to said manifold means and having an outlet port intermittently coupled to said inlet port with conduit means coupling said outlet port to said slug-ejecting port means; and g. first control valve timing means for controllably actuating said first control valve means to simultaneously close said normally open outlet port and open said normally closed outlet port for ram extension; and h. second control valve timing means for controllably actuating said second control valve means to intermittently couple said second control valve means inlet port to said second control valve means outlet port.

2. The combination as defined in claim 1 being particularly characterized in that said gaseous fluid is air.

* * * * *